United States Patent [19]

Wells et al.

[11] 4,401,466

[45] Aug. 30, 1983

[54] PROCESS FOR PROTECTION OF NOZZLES AND REFRACTORY LINING OF A VESSEL FOR REFINING MOLTEN METAL

[75] Inventors: William Wells, Charlotte, N.C.; Dalton Nose, Rio de Janerio, Brazil

[73] Assignee: Korf Technologies, Inc., Charlotte, N.C.

[21] Appl. No.: 325,958

[22] Filed: Nov. 30, 1981

[51] Int. Cl.[3] ..... C21C 5/34; C21C 5/42

[52] U.S. Cl. ..... 75/60; 75/59; 266/218; 266/265

[58] Field of Search ..... 75/59, 60, 52; 266/218, 266/265

[56] References Cited

U.S. PATENT DOCUMENTS

| | | | |
|---|---|---|---|
| 3,330,645 | 7/1967 | DeMoustier | 75/59 |
| 3,663,201 | 5/1972 | Heitmann | 75/60 |
| 3,844,768 | 10/1974 | Leroy | 75/59 |
| 3,859,078 | 1/1975 | Haysom | 75/60 |
| 3,898,079 | 8/1975 | Eriksson | 75/59 |
| 3,990,888 | 11/1976 | Eriksson | 75/59 |
| 3,999,977 | 12/1976 | Kolb | 75/60 |

*Primary Examiner*—P. D. Rosenberg

*Attorney, Agent, or Firm*—Ralph H. Dougherty

[57] ABSTRACT

A process for protecting oxygen injection nozzles and the surrounding refractory lining of a molten metal refining vessel having such oxygen injection nozzles beneath the bath surface. The injection nozzle comprises at least three concentric pipes, the central conduit thereof being connected to a source of oxygen, the outer annular conduits thereof each being supplied with a protective fluid, said protective fluid containing at least one hydroxyl compound or water or a mixture thereof. The protective hydroxyl compounds are selected from the gaseous or liquid alcohol group and preferably from the aliphatic alcohol group. Methanol, ethanol, propanol and butanol are preferred alcohols.

Apparatus for carrying out the process is also disclosed.

14 Claims, 2 Drawing Figures

PROCESS FOR PROTECTION OF NOZZLES AND REFRACTORY LINING OF A VESSEL FOR REFINING MOLTEN METAL

This invention relates to a method for refining molten metal, and more particularly to the refining of iron to steel.

When refining molten metal, particularly liquid pig iron, in an open hearth furnace, an electric arc furnace or in a converter by introducing an oxygen-containing gas into the molten metal below the surface of the bath, there is a problem involving the protection of the nozzle and the refractory lining of the vessel surrounding the nozzle from too rapid wear. In general, gaseous or liquid hydrocarbon compounds are used as a protective fluid for this purpose.

OBJECT OF THE INVENTION

The principal object of the invention is to reduce the nozzle and refractory lining consumption in a process for refining molten metal, thus attaining a longer service life of the device for injection of the oxygen-containing gas.

SUMMARY OF INVENTION

The present invention is a process for protecting oxygen injection nozzles and the surrounding refractory lining of a molten metal refining vessel having such oxygen injection nozzles beneath the bath surface. The injection nozzle comprises at least three concentric pipes, the central conduit thereof being connected to a source of oxygen, the outer annular conduits thereof each being supplied with a protective fluid, said protective fluid containing at least one hydroxyl compound or water or a mixture thereof. The protective fluids can be the same in each annular passageway or they can be different compounds or mixtures.

It has become possible through the process of the invention to attain a service life of the nozzles and the refractory lining surrounding the nozzles of 400 operating hours. The extended service life of the nozzles compared to that in known processes is attributed to the increased heat of dissociation of hydroxyl compounds compared to hydrocarbon compounds. It has been determined that 0.38 kg of alcohol exhibits the same heat of dissociation when used for local cooling as 1 kg of propane ($C_3H_8$). It is also possible to blend the hydroxyl compounds with water or to use only water for cooling. Water must be atomized or vaporized to be effective.

Particularly suitable hydroxyl compounds are liquid ones that are miscible with water and remove as much heat as possible from the surroundings through an endothermic dissociation reaction. Monovalent or polyvalent aliphatic or aromatic alcohols are particularly suitable for this purpose.

DESCRIPTION OF THE DRAWINGS

The present invention will be more readily understood by referring to the following detailed description and the appended drawings, in which.

DETAILED DESCRIPTION

Figure 1:
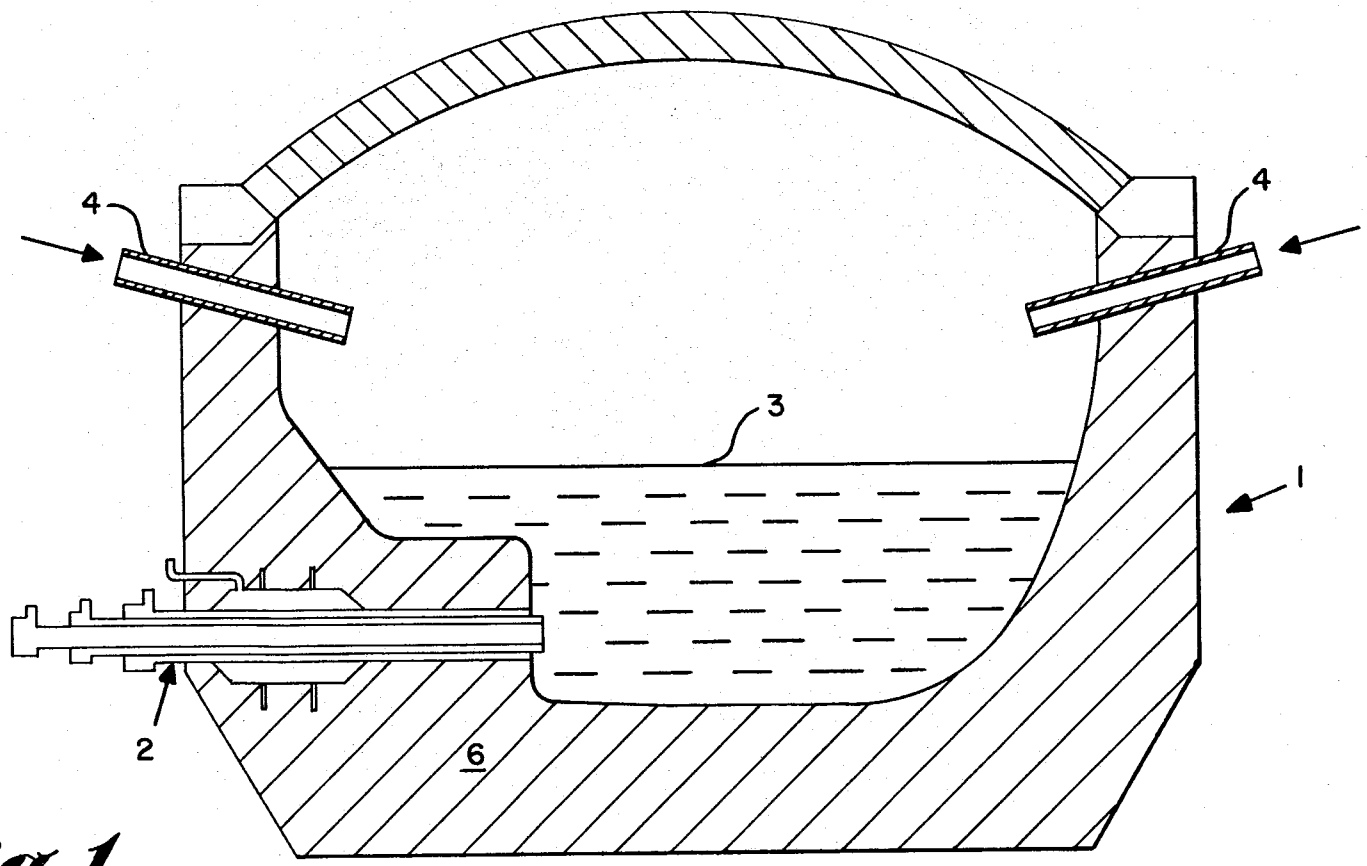
FIG. 1 is a sectional view of an injection device according to the invention in a hearth-type furnace.

Referring now to FIG. 1, a hearth-type furnace 1 such as an open hearth furnace, has an injection device 2 installed in the sidewall thereof at at least one location, the device opening into the vessel under the bath level 3. Two burners 4 are directed downwardly toward the bath above the bath level.

Figure 2:
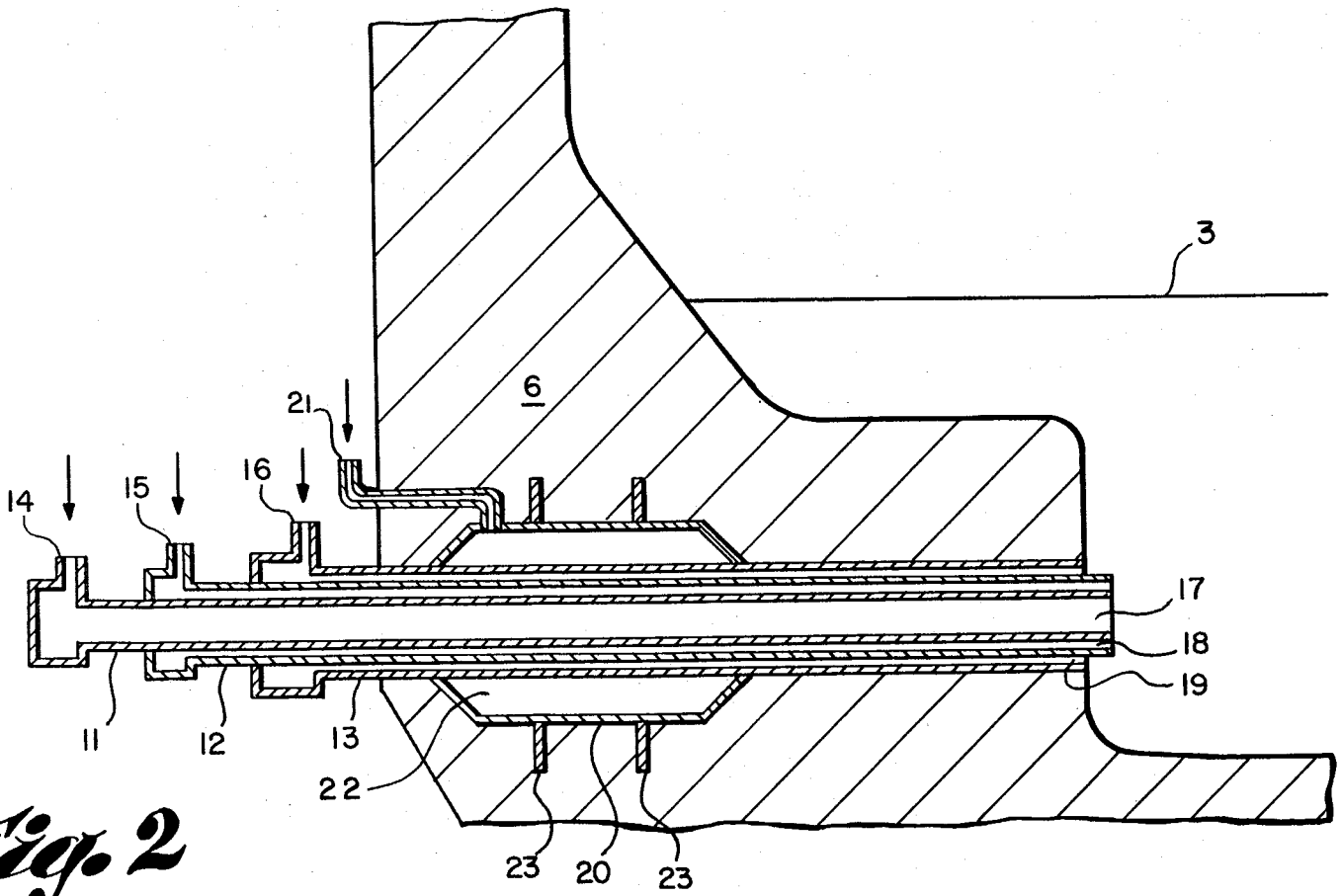
FIG. 2 is an enlarged sectional view of a portion of FIG. 1 showing the injection device with greater clarity.

As can be seen in FIG. 2, the injection nozzle consists of three concentric pipes 11, 12, 13 held apart by spacers (not shown), each of which is provided with a respective gas inlet 14, 15, 16 for gases or gas mixtures. These pipes form a central conduit 17 and a first annular conduit 18 and a second annular conduit 19. The opening of the pipes into the furnace interior can, as depicted, be designed in the form of annular conduits but also with annular discs covering the annular conduits with outlet openings along the circumference. The outer pipe 13 is anchored in the brickwork 6. In the outer region of the furnace wall, outer pipe 13 is surrounded by a closed pipe section 20 having an inlet 21 for a gaseous medium to maintain a positive pressure within chamber 22. Two concentric discs 23 are mounted on the outer surface of this pipe section 20. The pipe section 20, including the associated discs 23, serves to prevent the combustible gases flowing back between the refractory material and the outer jacket pipe. Pipe section 20 is optional. Alternatively, discs 23 may be mounted on the outer jacket pipe 13.

Oxygen is injected during the refining process through the central conduit 17. Alcohol is supplied through the first annular conduit 18, which changes to a gaseous state at the tip of the nozzle because of the temperatures prevailing there. A mixture of 50% alcohol and 50% carbon dioxide is injected through the second annular conduit 19. Nitrogen is supplied to the pipe section 20 through inlet 21.

The following indicates the process conditions for a preferred embodiment.

The concentrically arranged pipes of the injection device have the following dimensions:

| | |
|---|---|
| Inner pipe 11 | Inner Diameter 13 mm<br>Outer Diameter 16 mm |
| First jacket pipe 12 | Inner Diameter 20 mm<br>Outer Diameter 26 mm |
| Second jacket pipe 13 | Inner Diameter 32 mm<br>Outer Diameter 48 mm |
| Pipe section 20 | Inner Diameter 60 mm<br>Outer Diameter 72 mm |
| Concentric discs 23 | Outer Diameter 150 mm |

Pressure and throughput of the gases/gas mixtures measured in the supply lines to the individual pipes 11, 12, 13:

| | |
|---|---|
| Pipe 11 and central conduit 17: | 3.5 bar<br>3 $m^3$/min |
| First jacket pipe 12 and first annular conduit 18: | 2.5 bar<br>0.3 $m^3$/min |
| Second jacket pipe 13 and second annular conduit 19: | 2.5 bar<br>0.3 $m^3$/min |

The values indicated apply to a 25 ton open hearth furnace. The indicated gas pressure values increase by about 0.5 to 1 bar for larger furnaces and with application of the injection device in a converter.

If a mixture of alcohol and water is supplied through the first conduit instead of alcohol alone, the pressure is increased as well. A pressure of 3.5 bar has shown itself to be suitable with a mixture of 60% alcohol and 40% water.

Table I shows the acceptable broad ranges of fluid pressures and flow rates through the three gas passageways.

TABLE I

| Conduit | Fluid | Pressure (Bar) | Flow ($Nm^3$/min) |
|---|---|---|---|
| 17 | Oxygen | 2.5 to 4.5 | 2.0 to 5.0 |
| 18,19 | Carrier Gas | 2.0 to 3.5 | 0.2 to 0.6 |
| | Protective Fluid | 4.0 to 6.0 | 0.3 to 0.7 l/min |

Table II shows the preferred ranges of fluid pressures and flow rates through the three gas conduits.

TABLE II

| Conduit | Fluid | Pressure (Bar) | Flow ($Nm^3$/min) |
|---|---|---|---|
| 17 | Oxygen | 3.0 to 4.0 | 3.0 to 4.0 |
| 18,19 | Carrier Gas | 3.0 to 3.5 | 0.3 to 0.5 |
| | Protective Fluid | 4.5 to 5.5 | 0.4 to 0.6 l/min |

The carrier gas in the examples of Tables I and II is preferably nitrogen. The gas indicated as oxygen can be any oxidizing gas or oxygen-containing gas.

What is claimed is:

1. Process for protection of underbath blowing nozzles and refractory lining of a vessel for refining a bath of molten metal therein wherein an injection device projects through the vessel wall below the bath surface, said injection device being composed of at least three concentric pipes with annular gas passageways therebetween, said process comprising:

injecting oxygen through the central conduit of said device and injection a protective fluid through the annular passageways thereof, said protective fluid containing at least one of the group comprising an hydroxyl compound, water, and a blend of the two.

2. Process according to claim 1, characterized in that the hydroxyl compound is selected from the gaseous and liquid alcohol group.

3. Process according to claim 2, characterized in that the hydroxyl compound is selected from the aliphatic alcohol group.

4. Process according to claim 3, characterized in that the hydroxyl compound is selected from the methanol, ethanol, propanol and butanol group.

5. Process according to claim 1, characterized in that the blend of hydroxyl compounds and water contains at least 40% water by weight.

6. Process according to claim 1, characterized in that at least one hydroxyl compound is supplied through the inner annular passageway (18) and a blend of at least one hydroxyl compound and carbon dioxide is supplied through the outer annular passageway (19).

7. Process according to claim 1, characterized in that at least one hydroxyl compound is supplied through the inner annular passageway (18) and a blend of at least one hydroxyl compound and an inert gas is supplied through the outer annular passageway (19).

8. Process according to claim 6, characterized in that the proportion of the carbon dioxide is increased during the course of the refining process.

9. Process according to claim 1 wherein said protective fluid is water in atomized form.

10. Apparatus for injecting treating gas into a molten metal-containing vessel beneath the surface of the molten metal therein, comprising:

a central pipe connected to a source of treating gas; an annular jacketing pipe surrounding said central pipe and spaced therefrom to form an annular gas passageway therebetween, said jacketing pipe being connected to a source of protective gas;

an outer pipe surrounding said jacketing pipe and spaced therefrom to form an annular space therebetween, said outer pipe being connected to a source of protective gas; and a pair of spaced discs mounted external to and concentric with said outer pipe.

11. Apparatus according to claim 10 further comprising a tubular chamber surrounding said outer pipe.

12. Apparatus according to claim 11 wherein said discs are mounted on said chamber.

13. Process according to claim 1 wherein said protective fluid is water in vaporized form.

14. Apparatus according to claim 11 further comprising an inlet for a gaseous medium to maintain a positive pressure within said tubular chamber.

* * * * *